United States Patent [19]

Terai et al.

[11] Patent Number: 4,987,062

[45] Date of Patent: Jan. 22, 1991

[54] PROCESS FOR PREPARING A SILVER HALIDE EMULSION

[75] Inventors: Fumitaka Terai, Saitama; Hiroyuki Yamagami, Kanagawa; Nobuhiko Uchino, Kanagawa; Masaki Okazaki, Kanagawa, all of Japan

[73] Assignee: Fuji Photo Film Co., Ltd., Kanagawa, Japan

[21] Appl. No.: 375,559

[22] Filed: Jul. 5, 1989

[30] Foreign Application Priority Data

| | | | |
|---|---|---|---|
| Jul. 4, 1988 | [JP] | Japan | 63-164910 |
| Jul. 4, 1988 | [JP] | Japan | 63-164911 |
| Jul. 12, 1988 | [JP] | Japan | 63-171878 |

[51] Int. Cl.[5] ..... G03C 1/10

[52] U.S. Cl. ..... 430/546; 430/581; 430/636; 430/638; 430/935

[58] Field of Search ..... 430/546, 581, 636, 935, 430/638

[56] References Cited

U.S. PATENT DOCUMENTS

| | | | |
|---|---|---|---|
| 3,822,135 | 7/1974 | Sakai et al. | 96/101 |
| 3,837,863 | 9/1974 | Sakazume et al. | 96/130 |
| 4,193,801 | 3/1980 | Hopwood et al. | 430/570 |

*Primary Examiner*—Paul R. Michl
*Assistant Examiner*—Janis L. Dote
*Attorney, Agent, or Firm*—Sughrue, Mion, Zinn, Macpeak & Seas

[57] ABSTRACT

A process for preparing a silver halide emulsion is disclosed, which comprises dissolving one or more substantially water-insoluble photographic additives in a solution of an organic solvent containing a surface active agent having a hydrophilic —$SO_3$ or —$OSO_3$ group wherein said organic solvent is an alcohol, and then adding the resulting solution to a silver halide emulsion. A small amount of a base, or small amounts of a base and an acid may optionally be present in the mixed solution of the organic solvent and the surface active agent prior to adding the one or more substantially water-insoluble photographic additives.

4 Claims, 2 Drawing Sheets

PROCESS FOR PREPARING A SILVER HALIDE EMULSION

FIELD OF THE INVENTION

The present invention relates to a process for preparing a silver halide photographic emulsion. More particularly, the present invention relates to a process for obtaining desired photographic properties by adding one or more substantially water-insoluble photographic additives to a silver halide emulsion as a mixed solution of the one or more substantially water-insoluble additives in a small amount of an organic solvent containing a small amount of a surface active agent.

BACKGROUND OF THE INVENTION

Conventional methods for adding water-insoluble photographic additives to a silver halide photographic emulsion include the following processes: (1) dissolving a photographic additive or additives in an organic solvent such as methanol and then adding the resulting solution to a silver halide emulsion as described, for example, in JP-B-50—40659 (The term "JP-B" as used herein means an "examined Japanese patent publication"), U.S. Pat. No. 3,788,857, JP-A-50—11419 (The term "JP-A" as used herein means an "unexamined published Japanese patent application"), U.S. Pat. No. 3,660,101, and JP-B-49—46416; (2) dissolving a water-insoluble photographic additive or additives in an organic solvent, mixing the resulting solution with water, then removing said organic solvent to form a dispersion in water as described, for example, in JP-A-49—128725; (3) solubilizing a water-insoluble photographic additive or additives, and adding the solubilized solution to a silver halide emulsion as described, for example, in JP-B-49—44895; and (4) mechanically dispersing a substantially water-insoluble photographic additive or additives in an aqueous system, and adding the dispersion of the photographic additives to a silver halide emulsion as described, for example, in JP-A-52—110012, JP-A-53—102733 and U.S. Pat. No. 4,006,025.

However, conventional process (1) above requires an organic solvent in an amount at least equal to the solubility of the additives. Hence, when using photographic additives which are only slightly soluble in the organic solvent, a large amount of organic solvent must be used to dissolve the additives, which causes the formation of agglomerates upon addition of the solution or dispersion thereby obtained to the emulsion or causes coating defects such as seediness or streaks.

Conventional process (2) above causes a change in concentration or decomposition of the photographic additives in the step of removing the organic solvent (by evaporation or membrane separation), thus requiring complicated production steps.

In conventional process (3) above, wherein a solution solubilized by a surface active agent is added to a silver halide emulsion, emulsified particles existing in the silver halide emulsion are destroyed. Additionally, coating becomes increasingly difficult as the coating speed of a silver halide emulsion is accelerated, and the adhesiveness of the resulting silver halide light-sensitive materials is deteriorated.

In conventional process (4) above, the desired effects of the additives are reduced, and coating defects arise due to formation of precipitates, etc.

Further, a conventional process of adding an organic solvent solution of photographic additives to water or an aqueous solution containing an anionic surface active agent results in recrystallization upon addition. With some additives, the recrystallized crystals are not dispersible, but remain as coarse crystals of size 20 to 50 μm which, when added to a silver halide, require a long time for such photographic additives such as spectral sensitizing agents to adsorb onto the silver halide grains and the additives thus fail to provide the desired photographic properties. Moreover, such emulsions are liable to cause coating defects due to the formation of precipitates, etc.

In a conventional process of adding a solution of a photographic additive or additives in an organic solvent to an aqueous solution containing an aqueous binder or a hydrophilic colloid, the dispersing efficiency is good due to the high viscosity of the aqueous binder solution or hydrophilic colloid in spite of the recrystallization. Recrystallization takes place upon addition of the solution, as described above. Extensive foaming occurs upon dispersion due to the large input power required for dispersion. The coars crystals become enveloped in the foam and remain as such to similarly cause coating defects.

SUMMARY OF THE INVENTION

In view of the above-described technical problems, an object of the present invention is to provide a process for preparing a silver halide emulsion, which does not produce agglomerates or result in the destruction of the emulsion upon addition of the water-insoluble photographic additives to a silver halide emulsion, which does not cause defects (seediness, streaks, poor adhesion, etc.) in the coating step, and which provides a stable silver halide emulsion without precipitation or decomposition of the photographic additives.

Another object of the present invention is to provide a stable silver halide emulsion which does not cause coating defects, which allows for dispersion of substantially water-insoluble additives without the formation of coarse particles due to recrystallization, and without causing formation of agglomerates and destruction of the emulsion.

As a result of intensive investigations on the above-described problems, the present inventors have found that, substantially water-insoluble photographic additives, even those which are not soluble using surface active agents and which require a large amount of an organic solvent for dissolution, can be dissolved in markedly reduced amounts of a mixed solution of an organic solvent comprising an alcohol and an anionic surface active agent. In order to minimize decomposition of the photographic additives with time during storage of the mixed solution, it is effective to add a small amount of a base or small amounts of a base and an acid to the mixed solution. The present invention has been achieved based on the above-described findings.

As a result of further investigations, the present inventors have found that, upon dispersion in the emulsion, the copresence of photographic additives having good dispersibility in water accelerates the dispersion of the less soluble additives, thus achieving a second embodiment of the present invention.

That is, the above-described objects of the present invention are attained by: (1) a process for preparing a silver halide emulsion, which comprises dissolving one or more photographic additives in a solution of an organic solvent containing a surface active agent having a hydrophilic $-SO_3$ or $-OSO_3$ group wherein said organic solvent is an alcohol, and adding the resulting solution to a silver halide emulsion; (2) a process for preparing a silver halide emulsion as described in (1), wherein a small amount of a base or small amounts of a base and an acid are added to the mixed solution of said organic alcohol solvent and said surface active agent, the one or more substantially water-insoluble photographic additives are dissolved therein; and (3) a process for preparing a silver halide emulsion as described in (1), wherein said mixed solution is dropwise added to water to recrystallize the water-insoluble photographic additives and wherein other photographic additives having good dispersibility in water are added, the resulting mixture being dispersed in a dispersing machine, and the resulting dispersion is then added to a silver halide emulsion.

BRIEF DESCRIPTION OF THE DRAWINGS

In FIGS. 1, 2 and 4, the numeral 1 designates a tank, 2 designates a solution, 3 designates a stirring blade, and 4 designates a stirring shaft.

FIG. 4 is a schematic side elevation view of a high-speed stirring machine for dispersion for use in the process of the present invention.

In FIGS. 4 and 5, the numeral 1 designates a tank, 2 designates a solution to be dispersed, 3 designates a dissolver, 31 designates an impeller, and 32 and 33 designate blades.

DETAILED DESCRIPTION OF THE INVENTION

Figure 1:
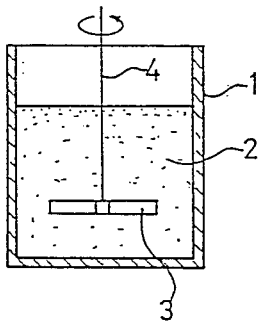
FIG. 1 is a schematic side elevation cross-sectional view of a stirring and dissolving machine for use in the process of the present invention.

Substantially water-insoluble photographic additives for use in the process of the present invention are solid additives including spectral sensitizing dyes, antifogging agents, color couplers, dyes, sensitizing agents, hardeners, ultraviolet ray absorbents, antistatic agents, brightening agents, desensitizers, developing agents, anti-fading agents, mordants, etc.

Substantially water-insoluble means that not more than 0.1 grams of an additive will dissolve in 100 grams of water at 50° C.

These additives are described in RESEARCH DISCLOSURE, vol. 176, RD—17643, pp. 22–31 (December 1978).

Examples of the spectral sensitizing agents for dispersion by the process of the present invention include for example, methine dyes such as cyanine dyes, merocyanine dyes, hemicyanine dyes, rhodacyanine dyes, oxonol dyes and hemioxonol dyes and styryl dyes. Of these dyes, anionic dyes such as those which contain one or more, preferably two or more, sulfo or sulfoalkyl groups as substituents are particularly effective.

The spectral sensitizing agents which are described in the following publications may be used in addition to those described in the above-mentioned publication: German Patent No. 929,080, U.S. Pat. Nos. 2,493,748, 2,503,776, 2,519,001, 2,912,329 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, 4,026,707, British Patent Nos. 1,242,588, 1,344,281, 1,507,803, JP-B-44—14030, JP-B-52—24844, JP-B-43—4936, JP-B-53—12375, JP-A-52—110618, JP-A-52—109925, and JP-A-50—80827.

Additives other than the above spectral sensitizing agents for dispersion in the process of the present invention include benzotriazole compounds, 4-thiazolidone compounds, benzophenone compounds, cinnamic ester compounds, butadiene compounds, benzoxazole compounds, cationic polymers, chromium salts, aldehydes, N-methylol compounds, dioxane derivatives, active vinyl compounds, active halogen compounds, mucohalogenic acids, nitroindazoles, triazoles, benzotriazoles, benzimidazoles, mercaptothiazoles, mercaptobenzothiazoles, tetraazaindenes, 5-pyrazolone couplers, pyrazolone benzimidazole couplers, acylacetamide couplers, naphthol couplers, phenol couplers, etc.

Amounts of the substantially water-insoluble photographic additives to be added to the silver halide emulsion vary depending on the types of additives, the amount of the silver halide, etc., but amounts employed in conventional processes may generally be employed. For example, the addition amount is 0.003 to 0.3 g per 100 g of silver halide emulsion.

The present invention is particularly advantageous when the photographic additives are cyanine spectral sensitizing dyes, excluding the anionic cyanine dyes.

An example of such a cyanine dye is represented by the formula below.

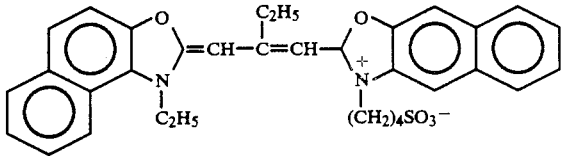

(hereinafter referred to as dye A)

(hereinafter referred to as dye A)

The organic alcohol solvents for use in the process of the present invention include aliphatic saturated alcohols (e.g., methanol, ethanol, isopropyl alcohol), aliphatic unsaturated alcohols (e.g., allyl alcohol), alicyclic alcohols (e.g., cyclohexanol), aromatic alcohols (e.g., 2-phenyl ethanol), and heterocyclic alcohols (e.g., furfuryl alcohol, tetrafurfuryl alcohol). Aromatic primary alcohols and halogenated alcohols are particularly preferred.

For example, benzyl alcohol ($C_6H_5CH_2OH$) (hereinafter referred to as organic solvent B) and fluorinated alcohol ($HCF_2CF_2CH_2OH$, hereinafter referred to as organic solvent C) or ($CF_3CH_2OH$, hereinafter referred to as organic solvent F) are useful in the process of the present invention.

The surface active agents having a hydrophilic $-SO_3$ or $-OSO_3$ group include anionic active agents such as alkylsulfates (e.g., $C_{12}H_{25}OSO_3Na$), alkylsulfonates (e.g., $C_{12}H_{25}SO_3Na$), alkylarylsulfonates

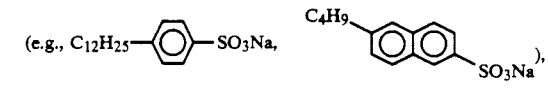

sulfosuccinates (e.g., surface active agent E as below), etc. For example, the compounds represented by the formula below are surface active agents useful in the process of the present invention.

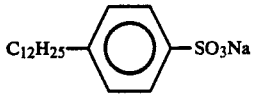

(hereinafter referred to as surface active agent D)

and $$\begin{array}{l} CH_2COOCH_2CH(C_2H_5)C_4H_9 \\ | \\ NaO_3SCHCOOCH_2CH(C_2H_5)C_4H_9 \end{array}$$

(hereinafter referred to as surface active agent E).

When the solution prepared by adding the surface active agent having a hydrophilic $-SO_3$ or $-OSO_3$ group to the organic alcohol solvent is used as a mixture for dissolving the photographic additives (i.e., the mixed solution), the amount of surface active agent present is generally from 25 to 100 wt%, preferably 25 to 75 wt% based on the amount of the photographic additives, and the amount of the organic alcohol solvent is generally from about ⅓ to about ½ of the amount necessary for dissolving the additives using only the organic solvent alone at 70° C. The above addition amounts vary depending upon the type of organic solvent and surface active agent employed.

As to the base, or the base and acid, to be added in the present invention to the mixed solution, an organic base (e.g., propylamine, butylamine, diisopropylethylamine, triethylamine) is preferable as the base, and a weak acid (e.g., acetic acid, propionic acid, pivalic acid) is preferable as the acid. Amounts thereof to be added are 1 to 7 wt% based on the amount of the photographic additives. As to manner of addition, the base, or the base and acid, may be added before or after addition of photographic additives to the aforesaid mixed solution. The addition of the base, or the base and acid, is considered to have a pH-buffering effect.

In the silver halide emulsion for use in the process of the present invention, any of silver bromide, silver iodobromide, silver iodochlorobromide, silver chlorobromide, silver chloride, etc. may be used as the silver halide. The grain size of silver halide is not particularly limited, but grain sizes not greater than 3 μ are preferable. These silver halide emulsions are readily prepared by the processes described in P, Glafkides; "Chimie et Physique Photographique" (Paul Montel, 1967), G. F. Duffin; "Photographic Emulsion Chemistry" (The Focal Press, 1966, V.L. Zelikman et al; Making and Coating Photographic Emulsion" (The Focal Press, 1964), etc.

An acid process, neutral process or an ammonia process can be used to prepare the silver halide emulsion. The soluble silver salt and the soluble halide salt may be reacted by means of a single jet mixing process, a double et mixing process, or a combination thereof.

A process of forming the silver halide grains in the presence of excess silver ion (a reverse-mixing process) can be employed as well. As one type of double et mixing, a controlled double jet process wherein the pAg in the liquid phase wherein the silver halide grains are formed is kept constant can be employed. This process provides a silver halide emulsion containing silver halide grains having a nearly uniform grain size.

Two or more silver halide emulsions having been separately prepared may be mixed for use as the silver halide emulsion of the process of the present invention.

During formation or physical ripening of the silver halide grains, cadmium salts, zinc salts, lead salts, thallium salts, iridium salts or the complex salts thereof, rhodium salts or the complex salts thereof, iron salts or the complex salts thereof, etc. may be present.

Various other additives may be used in the silver halide emulsion for use in the process of the present invention including sensitizing agents (e.g., sulfur sensitizing agents, reduction sensitizing agents, noble metal sensitizing agents, etc.), stabilizers, surface active agents, hardeners, thickening agents, dyes, ultraviolet ray absorbents, antistatic agents, brightening agents, desensitizers, developing agents, anti-fading agents, mordants, etc. Further, couplers such as color couplers dispersed in an oil may be present.

These additives are described in RESEARCH DISCLOSURE (RD-17643), vol. 176, pp. 22–31 (December 1978), and THE THEORY OF THE PHOTOGRAPHIC PROCESS (4th Ed.) edited by T. H. James (Macmillan Publishing Co. Inc., 1977), and the like.

Gelatin is a preferred binder for use in the silver halide emulsion of the process of the present invention. In addition, gelatin derivatives such as phthalated gelatin, albumin, agar, gum arabic, cellulose derivatives, polyvinyl acetate, polyacrylamide, polyvinyl alcohol, etc. may be used as binders.

A process of preparing the silver halide emulsion according to the method of the present invention is described below. First, a weighed amount of an organic solvent is placed in tank 1 as shown, for example, in FIG. 1. A surface active agent is added thereto, followed by stirring by means of stirring blade 3 at room temperature to dissolve the surface active agent. As the stirring blade, a turbine blade having four blades fixed to stirring shaft 4 as shown, for example, in FIG. 2 is used. The ratio of the diameter of the turbine blade to the inside diameter of the tank is preferably from about 1:5 to about 2:5. The ratio of the diameter of turbine blade to the gap between bottom of the tank and turbine blade is preferably from about 2:1 to about 1:1. The ratio of the diameter of turbine blade to the height of the non-stirred still liquid in the tank is preferably from about 1:1 to about 1:3. The stirring blade is not limited to a turbine blade but may be a paddle blade, a propeller blade or a dissolver blade. Additionally, when a small amount of the emulsion is being prepared, a magnetic stirrer may be used.

In order to depress decomposition of the photographic additives with time, a suitable amount of the base, or of the base and acid, may be added to the resulting stirred and mixed solution. Further, mixed solution 2 is heated to 70° C. One or more photographic additives are added thereto, and the resulting mixture is stirred at 70° C. to dissolve the additives. After confirming complete dissolution, stirring is discontinued, and the temperature of the solution is decreased to from 40° to 50° C. for storage.

In order to attain a preferred embodiment (3) of the present invention, the mixed solution is dropwise added to stirred water to recrystallize the additives. A dissolver blade is used as the stirring blade.

The term "recrystallization" as used herein means that photographic additives which are dissolved in the compatible organic solvent precipitate when added to water (an incompatible solvent) to exceed the saturation solubility.

Other one or more photographic additives having good dispersibility in water are then added thereto without further addition of organic solvents, wetting agents or dispersing agents, and the resulting mixture is dispersed in a high-speed stirrer. Examples of well-dispersible photographic additives having good dispersibility in water include anionic cyanine spectral sensitizing dyes. Typical examples thereof are represented by the formula below.

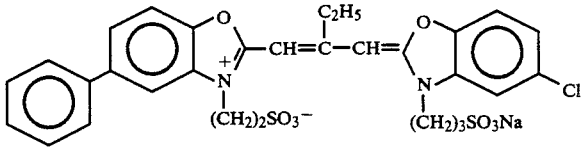

(hereinafter referred to as dye B),

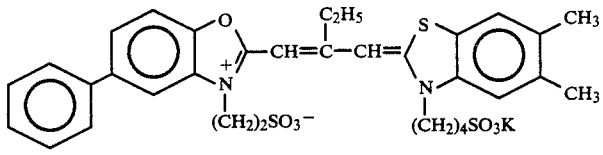

(hereinafter referred to as dye C)

and

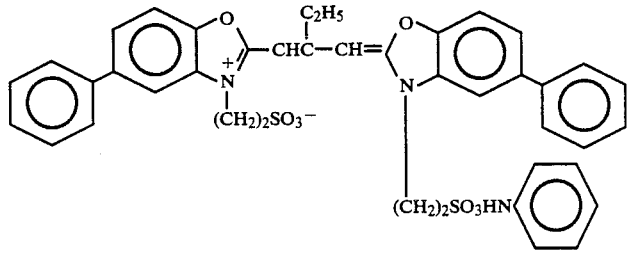

(hereinafter referred to as dye B),

As described hereinbefore, dispersion of additives poorly dispersible in water is promoted by dispersion in the copresence of a well-dispersible dye and a substantially water-insoluble dye having analogous molecular structures as illustrated above.

Additionally, well-dispersible photographic additives are, needless to say, those which can be added together with substantially water-insoluble photographic additives.

The addition amount of well-dispersible dye is from 1 to 10 g per gram of poorly dispersible dye.

The high-speed stirring machine for use as a dispersing machine has been described hereinbefore and, as to stirring conditions, a dispersing time of from 60 to 180 minutes, a dispersing temperature of about 40° to 60° C., and a pH of from 6.5 to 7.5 are preferable. The recrystallized additives are dispersed as particles having a size not exceeding 1 μm by this dispersing procedure.

In the present invention, a photographic additive which is well-dispersible in water can be mechanically dispersed in an aqueous solution without the use of organic solvents, wetting agents or dispersing agents.

The dispersion of poorly dispersible photographic additives in water can be promoted by dispersing in the copresence of the one or more well-dispersible additives.

Figure 4:
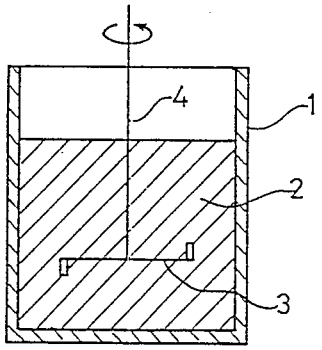
Figure 5:
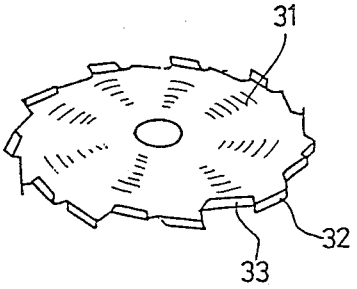
FIG. 5 is a perspective view of a dissolver blade.

In the present invention, to disperse in a dispersing machine means to use a stirring machine having a dissolver blade 3 turning at from 2,000 to 4,000 rpm as shown for example, in FIG. 4, in the mixture 2 to be dispersed and which is placed in tank 1. As shown in FIG. 5, dissolver blade 3 comprises impeller 31 having many sets of alternating perpendicular upward blades 33 and perpendicular downward blades 34.

The ratio of the diameter of impeller to the inside diameter of tank is preferably from about 1:5 to about 2:5. The ratio of the diameter of impeller to the gap between the bottom of tank and the impeller is preferably from about 2:1 to about 1:1. The ratio of the diameter of impeller to the height of the non-stirred, still solution in tank 1 is preferably about 1:3.

The solution obtained by the present invention may be directly added to a silver halide emulsion, or may first be mixed with a protective colloid and then added to the emulsion in a dissolved or gelated state to obtain the desired photographic properties.

The present invention is now illustrated in greater detail by reference to the following non-limiting examples.

EXAMPLE 1

Figure 3:
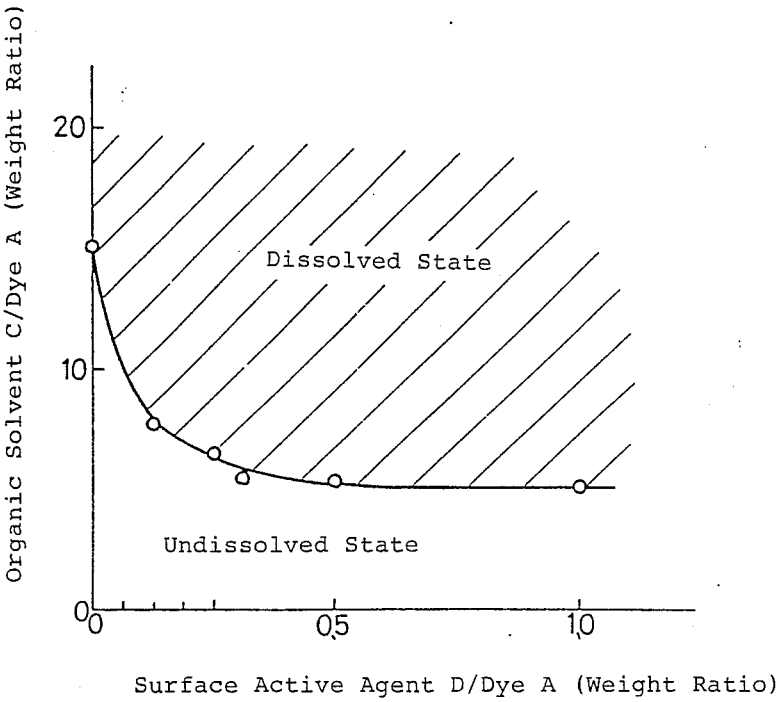
FIG. 3 is a graph showing the solubility curve of the weight ratio of organic solvent C/sensitizing dye versus weight ratio of surface active agent D/sensitizing dye.

As a water-insoluble photographic additive, 1.6 g of the aforesaid photographic spectral sensitizing cyanine dye A was used. Solutions were prepared by either adding or not adding the surface active agent D or E to various amount of the aforesaid organic solvents B and C, as given in Table 1 below, taking into consideration the solubility properties of the dye A as shown in FIG. 3 (i.e., the relation between organic solvent C/dye A and surface active agent D/dye A).

Figure 2:
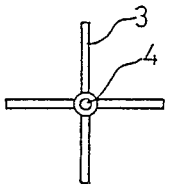
FIG. 2 is a top view of a stirring blade.

Each of the mixtures as given in Table 1 was stirred by an apparatus as shown in FIG. 1 and, after heating the mixtures to 70° C., aforesaid sensitizing dye A was added thereto, followed by stirring at 70° C. for 10 minutes in the same manner to dissolve the dye.

After cooling the resulting solutions to 40° to 50° C., the solutions were immediately each added to silver halide emulsions to prepare photographic light-sensitive emulsions.

TABLE 1

| Sample | Dye A (g) | Organic Solvent (g) | | Surface Active Agent (g) | | Mixed Solution (g) | Dis-solved State |
|---|---|---|---|---|---|---|---|
| Comparative Sample 1 | 1.6 | B | 40 | | — | 40 | $X_1$ |
| Comparative Sample 2 | 1.6 | C | 24 | | — | 24 | $X_2$ |
| Comparative Sample 3 | 1.6 | — | — | D* | 320 | 320 | $X_3$ |
| Sample 1 of the invention | 1.6 | B | 16 | D | 1.2 | 17.2 | O |
| Sample 2 of the invention | 1.6 | C | 10 | D | 0.4 | 10.4 | O |
| Sample 3 of the invention | 1.6 | C | 8 | E | 0.6 | 8.6 | O |

(Note)
$X_1$: Agglomerates were formed upon storage.
$X_2$: Oil droplets were formed.
$X_3$: not completely dissolved
O: completely dissolved
*20% aqueous solution of the surface active agent As is apparent from Table 1, in the samples of the present invention, the amount of organic solvent necessary for dissolving a substantially water-insoluble additive can be reduced by ½ or less than in the comparative samples by dissolving the additive in a solution of an organic solvent containing a surface active agent having a hydrophilic $-SO_3$ or $-OSO_3$ group wherein the organic solvent is an alcohol. In addition, generatron of aglomerates and destruction of the emulsion does not result from the addition of the mixed solution to the emulsion. Hence, no coating defects (seediness, streaks, poor adhesion, etc.) arise, and production of a good silver halide emulsion is realized.

EXAMPLE 2

1.59 g of the aforesaid photographic spectral sensitizing cyanine dye A was used as a water-insoluble photographic additive and was dissolved in the following mixed solution.

That is, the aforesaid surface active agent D was added to the aforesaid organic solvent B (benzyl alcohol) wherein acetic acid and triethylamine were further added thereto in small amounts as an acid and a base, respectively. Then, aforesaid dye A was added to this mixed solution, and the resulting solution was stirred at 75° C. for 5 minutes to dissolve the dye A.

After the dye A was completely dissolved, stirring was discontinued, and the solution was stored at 50° C for 4 hours during which change in the concentration of the added spectral sensitizing dye A was measured using an automatic spectrophotometer (340 type of HITACHI LTD.).

Formulations of Samples of the Invention and Comparative Samples are as shown in Table 2.

TABLE 2

| Run No. | Dye A (g) | Organic Solvent B (g) | Surface Active Aqent D (g) | Base (g) | Acetic Acid (g) |
|---|---|---|---|---|---|
| Comparative Sample 4 | 1.59 | 24 | — | — | — |
| Comparative Sample 5 | 1.59 | 10 | 0.8 | — | — |
| Sample of the Invention 4 | 1.59 | 10 | 0.8 | 0.1 | — |
| Sample of the Invention 5 | 1.59 | 10 | 0.8 | 0.1 | 0.1 |

The relative concentration of the dye A as a function of time was measured by the spectrophotometer the results of which are shown in Table 3. Specifically, preservability was evalutated by obtaining relative changes with respect to the concentration at the start of preservation.

TABLE 3

| Time (min.) | Comparative Samples 4 | Comparative Samples 5 | Samples of the Invention 4 | Samples of the Invention 5 |
|---|---|---|---|---|
| 0 | 100 | 100 | 100 | 100 |
| 20 | 94.1 | 75.7 | 98.7 | 100 |
| 60 | 83.3 | 24.3 | 97.9 | 100 |
| 120 | 73.9 | 7.1 | 96.0 | 99.3 |
| 240 | 40.3 | 2.1 | 90.2 | 98.5 |

(Note)
For each sample the concentration of the spectral sensitizing dye A after heating at 75° C. for 5 minutes to dissolve the dye was taken as 100.

As is shown above, Comparative Sample 5 wherein a solution prepared by merely mixing the organic solvent with the surface active agent suffered serious decomposition of the dye, whereas Sample 4 of the Invention further containing the base showed a markedly improved preservability, and Sample 5 of the Invention further containing both the base and the acid showed even less change in dye concentration, thus demonstrating improved stability with time.

Since the process of the present invention reduces the amount of organic solvent which is needed to introduce the substantially water-insoluble additives to a silver halide emulsion, coating defects due to precipitates or the like upon coating of the emulsion are prevented.

In addition, since the process eliminates the necessity of adding a large amount of surface active agent to a silver halide emulsion, the destruction of emulsion, detrimental effects upon high-speed coating, and poor adhesion are avoided.

Further, the process enables stable storage of the photographic additive solution for a long time.

EXAMPLE 3

Sample 6 of the Invention and Comparative Samples 6 and 7

To 10 g of benzyl alcohol used as an organic solvent were added 0.8 g of surface active agent D having a hydrophilic $-SO_3$ group as hydrophilic group, 0.1 g of triethylamine as the base and 0.1 g of acetic acid as the acid, and the resulting mixture was stirred at room temperature to prepare a solution. 1.59 g of the aforesaid dye A was added as a water-insoluble photographic additive to the solution, and the resulting mixture was heated at 70° C. for 10 minutes using a magnetic stirrer to prepare a solution. After completion of the dispersion, stirring was discontinued, and the solution was cooled to 50° C.

The thus-obtained solution was dropwise added to water, and recrystallized particles were dispersed in the manner described below.

The same procedure was repeated except that 8 g of fluorinated alcohol was used in place of 10 g of benzyl alcohol.

Comparative Sample 6

The aforesaid solution was dropwise added to 500 ml of water in 10 minutes to form recrystallized crystals and, after adjusting the pH to 7, the mixture was stirred in a high-speed stirring machine at 3,000 rpm and 50° C. for 120 minutes to disperse the crystals. Eventually, however, the dispersion failed.

Comparative Sample 7

The aforesaid solution was dropwise added to 500 ml of a 2 wt% gelatin aqueous solution over 10 minutes to form recrystallized crystals. After adjusting the pH to 7, the mixture was stirred at 50° C. for 120 minutes. Eventually, however, the dispersion failed. Additionally, extensive foaming occured.

Sample 6 of the Invention

The aforesaid solution was dropwise added to 500 ml of water in 10 minutes to form recrystallized crystals, and 8.12 g of the aforesaid dye B (a well-dispersible photographic additive) and 0.3 g of the aforesaid dye C were added thereto. After adjusting the pH to 7, the mixture was dispersed in a high-speed stirring machine at 3000 rpm at 50° C. for 120 minutes to disperse the crystals as particles of size up to 1 μm. When this dispersion was added to a silver halide emulsion and coated, no coating defects occured and good photographic properties were obtained. In the present invention, the obtained sensitivity was the same level as compared with the one which is obtained in a completely dispersed state.

As described above, the process of the present invention for preparing a silver halide emulsion wherein a substantially water-insoluble photographic additive is dispersed in combination with a well-dispersible additive enables the addition of photographic additives which have conventionally been impossible to effectively add to a silver halide emulsion due to poor dispersibility. In addition, the process of the present invention provides a stable silver halide emulsion without leaving coarse particles in a dispersion of recrystallized particles, without generation of agglomerates or destruction of emulsion, and without causing coating defects.

Further, since the amounts of the organic solvent and the surface active agent necessary for dissolving the substantially water-insoluble photographic additives are markedly decreased, a dispersion suffering no precipitation and no decomposition and having excellent stability is provided by the process of the present invention.

While the invention has been described in detail and with reference to specific embodiments thereof, it will be apparent to one skilled in the art that various changes and modifications can be made therein without departing from the spirit and scope thereof.

What is claimed is:

1. A process for preparing a silver halide emulsion, comprising the steps of dissolving one or more substantially water-insoluble photographic additives in a solution of an organic solvent containing a surface active agent having a hydrophilic $-SO_3$ or $-OSO_3$ group and a small amount of a base, or small amounts of a base and an acid present in the solution prior to addition of the one or more substantially water-insoluble photographic additives wherein said organic solvent is an alcohol, and then adding the resulting solution to a silver halide emulsion.

2. A process as in claim 1, wherein said substantially water-insoluble photographic additive is a photographic spectral sensitizing cyanine dye.

3. A process as in claim 1, wherein said organic solvent is an aromatic primary alcohol or a halogenated alcohol.

4. A process as in claim 1, wherein the amount of said surface active agent present in the solution is 25 to 100 wt% based on the amount of the one or more photographic additives.

* * * * *